United States Patent [19]

Gerdes

[11] 4,041,275

[45] Aug. 9, 1977

[54] ELECTRICAL HEATING ELEMENT

[76] Inventor: Claus-Holmer Gerdes, Pirolweg 1, 314 Luneburg, Germany

[21] Appl. No.: 572,089

[22] Filed: Apr. 28, 1975

[30] Foreign Application Priority Data

Mar. 25, 1975 Germany ..... 2513094

[51] Int. Cl.[2] ..... F24H 1/10

[52] U.S. Cl. ..... 219/307; 219/521; 219/544

[58] Field of Search ..... 219/307, 309, 316, 319, 219/345, 331, 374, 521, 523, 527, 530, 541, 544, 552; 338/221, 226, 229, 232, 233, 237, 252, 274, 279, 285

[56] References Cited

U.S. PATENT DOCUMENTS

| | | | |
|---|---|---|---|
| 1,480,174 | 1/1924 | Matthews | 219/319 X |
| 3,088,017 | 4/1963 | Schomann | 219/307 X |
| 3,119,918 | 1/1964 | Simon | 219/345 |
| 3,230,346 | 1/1966 | Eckerfeld et al. | 219/307 |
| 3,370,154 | 2/1968 | Fuchslocher | 219/309 |

FOREIGN PATENT DOCUMENTS

| | | | |
|---|---|---|---|
| 2,316,425 | 9/1974 | Germany | 219/307 |

*Primary Examiner*—Volodymyr Y. Mayewsky
*Attorney, Agent, or Firm*—Beall & Jeffery

[57] ABSTRACT

An electrical heating element for heating liquid media, e.g. water, for use in water heaters or the like and particularly in the form of a heating cartridge, comprising an insulated housing which is constructed in two parts of which a sleeve-like outer part receives in drawer-like manner an inner part, a duct system formed in the inner part comprising uninsulated heating coils for heating the medium flowing over them, and form-locked sealing means between the inner and outer part shaped onto these parts to avoid any direct passage of the medium to be heated from an inlet within the housing to a outlet, the form-locked sealing means being particularly in the form of groove and tongue joints.

10 Claims, 4 Drawing Figures

ELECTRICAL HEATING ELEMENT

BACKGROUND OF THE INVENTION

The invention relates to an electrical heating element with an insulated housing particularly in the form of a heating cartridge for heating liquid media such as water, oil or the like, particularly for use or incorporation in water heaters such as continuous flow heaters, coffee percolators, washing machines or the like with a duct system connecting an inlet with an outlet for the medium to be heated which flows over uninsulated heating coils within the duct system.

Heating cartridges of this type are, for example, known from DT-AS 1,106,004 corresponding to German Utility Model 1,810,419 and substantially comprise a parallelepiped-shaped cast resin member, within which the water and therefore heating ducts are juxtaposed in the form of cavities extending substantially in the longitudinal direction of the cartridge. To obtain an adequate duct length, the ducts are arranged to and fro. The duct system is produced by drilling blind holes from one narrow side of the parallelepiped. This narrow side is sealed by a locked cover plate and interposed insulation. On the opposite side are provided both an inlet and an outlet for the water. Electrical contact terminals are also provided on the said narrow side of the parallelepiped.

Although heating cartridges of this type have relatively high heating powers up to about 10 to 12 kW, their main disadvantages consist of a relatively complicated construction making it almost impossible to replace the heating coil when it burns out and the costly combersome manufacture, particularly of the duct system. Since the construction of the parallelepiped in one piece prevents the removal from an injection mould or conventional mould into which the ducts would have to be moulded, too, the ducts have to be drilled. Thus, three blind holes have to be drilled in the longitudinal direction of the parallelepiped, the two outer holes having the same diameter whilst the central hole has a larger diameter. This central hole is divided by a plug-in panel. The insertion of the heating coil into the thus produced duct system requires a great deal of skill and special tools so as not to damage the heating conductor windings during insertion. Furthermore, at the reversal points, the heating conductor must be stretched and bent which additionally stresses it and due to its close engagement with the wall, it can easily burn into the wall. As the removal of the heating conductor requires above average skill, its replacement and repair become substantially impossible, i.e. it is only possible to replace the complete heating cartridge. It must be borne in mind that with such heating cartridges, it is relatively easy for the heating coil to burn through if, for example, for any operational reason the water flow is interrupted and simultaneously the switch for the supply of power remains connected. Furthermore, through the drilling of the heating ducts, angles remain at the deflection points in which liquid can build up and bubbles of air can be deposited, which particularly with a low water pressure or low throughput, could easily lead to the annealing and burning out of the heavily loaded heating coil. Finally, after drilling, the ducts must be very carefully cleaned because any drillings remaining can either lead to obstructions in the liquid flow or to the scorching and therefore to an easier burning out of the heating conductor.

BRIEF SUMMARY OF THE INVENTION

Some of main objects of the invention are, whilst obviating the above disadvantages, to provide a heating cartridge which is of simpler construction, which comprises easy to manufacture components, whose assembly and dis-assembly provides no difficulties, which permits a replacement of the heating coil even by an unskilled person and which permits an effective sealing of the medium within the duct system by simple means so that the heating coil capacity is fully utilized.

According to the invention the heating element housing is constructed in two parts and a sleeve-like outer part receives in drawer-like manner with a snug sliding fit an inner part carrying the duct system with heating ducts open on one side over their entire length, both parts being inserted in one another in an easily detachable manner and the duct system being sealed in form-locked manner against any direct passage of the medium to be heated from the inlet to the outlet by sealing means shaped onto the inner part and the outer part along the entire length of the heating ducts.

Thus, in advantageous manner a heating cartridge is obtained which is both very easy to manufacture and permits easy rapid access to the heating coils. Unlike in the known heating cartridges, the core of the parallelepiped which carries the duct system is separated from the parallelepiped wall and is constructed as a drawer with the known top seal which need only be drawn out of the sleeve-like outer part to obtain access to the heating coils if the latter are to be replaced. Thus, from a manufacturing standpoint, a much more advantageous arrangement is obtained because no drilling with the resulting disadvantages is necessary. It is now in fact possible to obtain a duct system with fully rounded deflection points so that the heating conductors do not have to be stretched or mechanically stressed in any other way, whilst no angles are formed in which there is a build-up of flow and where bubbles of air can form and be deposited. The heating coils are in fact adapted perfectly to the duct and even at very low pressure there is a frictionless flow of the liquid to be heated. The form-locked sealing between the inner part and the outer part ensures that even with divergences from the snug sliding fit between outer part and inner part, the water still flows along the ducts formed in the inner part and the heating coils positioned therein without any "short circuit" being possible between the water inlet and the water outlet. In other words, there is a flow all round the heating coils which prevents any burning out of the coils due to a too limited water charge, as has been noted in the case of a lack of sealing means. Furthermore, the form-locked sealing means also prevent an incorrect insertion of the inner part into the outer part, i.e. preventing the inner part from being inserted into the outer part with a 180° inversion which could naturally happen as a result of the ease of replacement when the work is carried out with inadequate care or by an unskilled person and which would lead to the burning out of the heating coil. Thus, the inner part can only be inserted into the outer part when the heating ducts are in the correct position.

From a constructional and manufacturing standpoint, it has proved particularly advantageous to construct the form-locked sealing means as groove and tongue joints. The resulting advantages can be gathered from the following: The groove and tongue joints may be provided between the upper surfaces of the outer part and the inner part and the upper grooves and the upper tongues may extend over the entire length of the duct system along the partitions thereof. Consequently, the heating ducts are not only constructed in one of the two parts but due to the form-locking of the groove and tongue arrangement, there is an absolutely clear, resistant, lateral demarcation of the heating ducts, so that in any case a lateral overflow due to the pressure of the medium to be heated is avoided and the latter always follows and flows in the desired longitudinal direction of the heating ducts.

Additional groove and tongue joints can be constructed between the lower surfaces of the outer part and the inner part, and the lower tongues and lower grooves can extend over the contact length of the lower surfaces of the outer part and the inner part. These lower grooves and tongues ensure that there can be no short circuit between the water inlet and the outlet even on the detour via the lower contact surfaces of the inner part and the outer part, which normally would only be in flush engagement with one another. Thus, due to the form-locked barriers on both sides, it is ensured that all the water entering the heating cartridge flows through the duct system.

It is advantageously possible to provide the upper grooves in the outer part and the upper tongues as continuous projections of the duct system partitions on the inner part, which is also preferable from the manufacturing standpoint. Thus, all the essential projections are provided solely on the inner part which can be fitted more easily into the insertion opening of the outer part having exclusively grooves and recesses. In this connection, two lower grooves should be provided on the outer part and two lower tongues on the inner part for sealing the lower contact surfaces.

According to another advantageous development of the invention, the inner part sealingly engages against the outer part with a stop, whilst the inlet and outlet for the medium to be heated are provided in the outer part in the form of holes drilled through its wall, which permits the easy manipulation and particular fitting of the heating cartridge according to the invention. Advantageously, the stop is provided externally with a bracing rib constructed as a handle which increases the stability of the "drawer."

The inner part also preferably carries a pair of electrical connections in the form of screw bolts which are connected with the heating coils and pass through the outer part on the side opposite to the insertion opening of the outer part. This arrangement is particularly advantageous in view of the easy assembly or dis-assembly of the two plug-in parts, particularly as the electrical connections simultaneously serve as securing means, permitting a firm fitting of inner part into outer part so that there is an adequate pressure action on the seal between inner part and outer part.

Finally, the outer part can have a bearing bore for receiving an assembly or attachment screw for the heating element, permitting the latter to be rapidly and simply fitted and removed relative to a continuous flow heater or the like.

BRIEF DESCRIPTION OF THE DRAWINGS

Other and further objects of the present invention will become apparent from the following description and claims and are illustrated in the accompanying drawings which by way of illustration show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the scope of the appended claims. In the drawings show:

DETAILED DESCRIPTION OF THE PREFERRED EMBODIMENTS

Figures 1, 2, 3, 4:
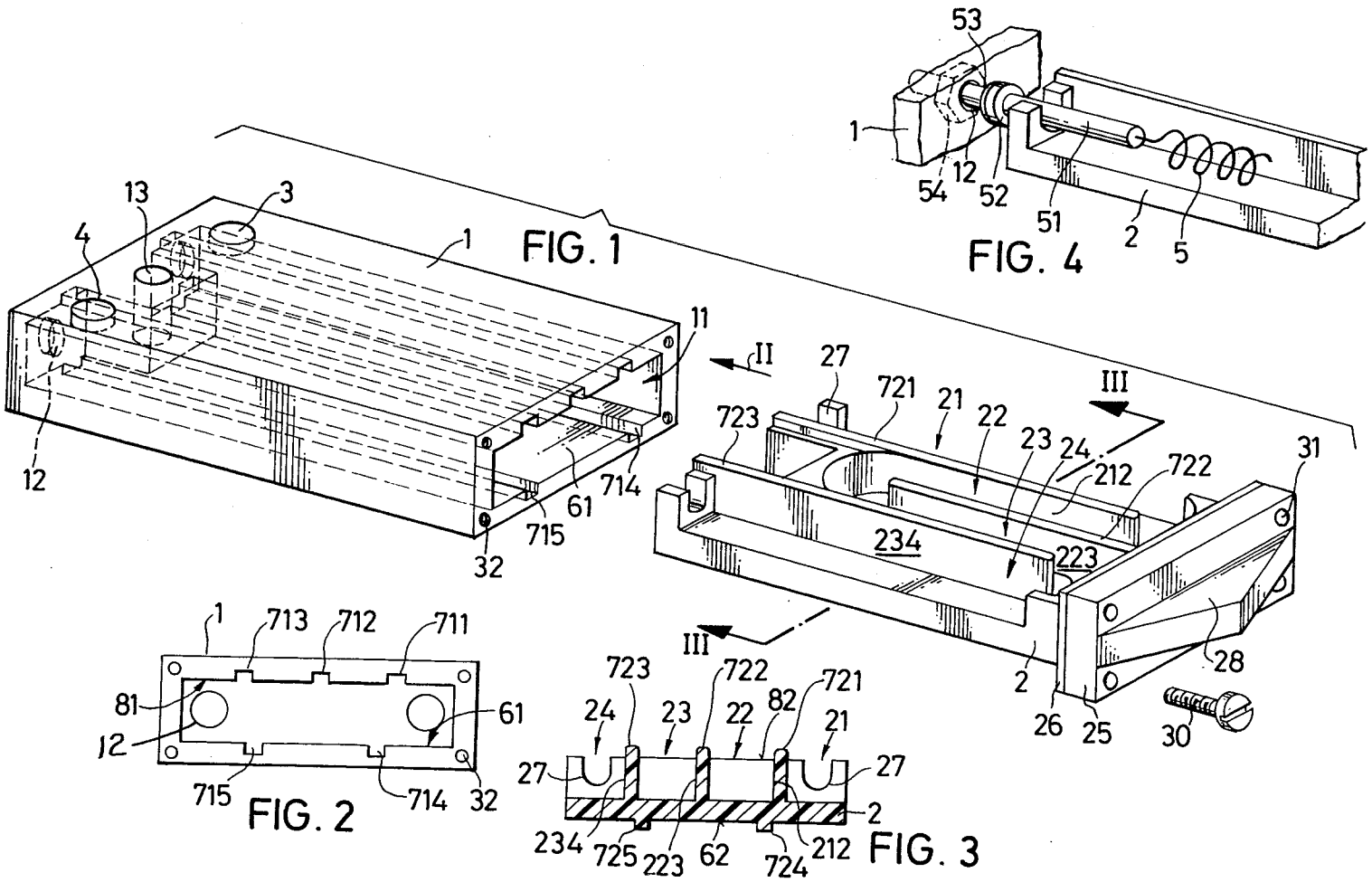
FIG. 1 the two main parts, specifically the outer part and inner part of the heating cartridge in a diagramatic exploded representation.
FIG. 2 a front view of the outer part viewed in the direction of arrow II.
FIG. 3 a section through the inner part along line III—III in FIG. 1.
FIG. 4 diagramatically a detail of the arrangement of the electrical connections.

The heating cartridge comprises an outer part 1 and an inner part 2. The inner part 2 carries the duct system which comprises individual series-connected ducts or duct branches 21, 22, 23, and 24 which pass into one another at well rounded deflection points. The ducts are separated from one another by walls 212, 223, and 234. The inner part 2 can be inserted into outer part 1 in drawer-like manner the outer part 1 for this purpose having a cavity with an insertion opening 11 on its one narrow side. The whole heating cartridge is substantially parallelepiped-shaped. The inner part 2 has a flange-like stop 25 with a seal 26 on its side which in the inserted state covers the insertion opening 11. The seal 26 engages against the narrow edges of outer part 1.

On the opposite side but on the main surface, the outer part 1 is provided with an inlet 3 and an outlet 4 for the water. These holes coincide with the corresponding ends of ducts 21 and 24. On this side but on the surface facing the insertion opening 11, outer part 1 has holes 12 through which pass screw bolts 51. Bolts 51 are connected with the heating coils 5 and provide the electrical contact form the outside. Recesses 27 coincide with said holes 12. Spacers 52 and seals 53 are provided on bolts 51 so that with the inner part 2 inserted, there is always an adequate sealing of holes 12. From the outside (cf. FIG. 2) a nut 54 is located on the bolts 51 by means of which the electrical contacts can be fixed to each bolt 51.

Inner part 2 is braced relative to outer part 1 on the side of abutment flange 25 by screwing with screws 30 which extend through holes 31 in flange 25 and are secured in threaded bores 32 in outer part 1.

To avoid a direct water passage via partitions 212, 223, 234 or along the lower contact surfaces 61 of the outer part and 62 of the inner part, a plurality of groove and tongue joints are provided. Thus, partitions 212, 223, and 234 of the inner part 2 project over the height of the remaining parts and the vertical clearance of the insertion opening of the outer part and thereby form tongues 721, 722, and 723, which engage in corresponding grooves 711, 712, and 713 in upper contact surface 81 of the outer part l. On the under side of the inner part 2 are provided two further tongues 724 and 725 which engage in corresponding grooves 714 and 715 in the outer part 1.

The plurality of groove and tongue joints ensure that the water entering at 3 successively flows through ducts 21, 22, 23, and 24 and flows out again at 4 because the form-locking prevents a cross-flow of the water, as would be possible if only planar contact surfaces were provided. Furthermore, the grooves and tongues facilitate centering of inner part 2 in outer part 1.

Naturally, it must be ensured that the tongues substantially fill the grooves and that more particularly an engagement against the base of the grooves is ensured, i.e. the tongues must have an adequate height. Thus, a snug fit is necessary here.

The groove and tongue arrangement also ensures that inner part 2 cannot be inserted into outer part 1 inverted by 180°. If insertion took place with such a displacement, inlet 3 and outlet 4 would not coincide with the corresponding ducts 21 and 24 which could lead to considerable damage.

To facilitate handling during assembly and dis-assembly, a handle-like bracing rib 28 is provided on stop 25 of inner part 2, whilst for attaching the heating cartridge in a hot water appliance, a bore 13 is provided in outer part 1.

With inner part 2 inserted and with heating coils 5 arranged therein, the water passes through inlet 3 into the duct system, passes through the latter, is heated on the uninsulated heating coil resistance and passes out again through bore 4.

While there has been described and illustrated the preferred embodiments of the invention, it is to be understood that these are capable of variation and modification and it is not therefore desired to be limited to the precise details set forth, but to include such modifications and alterations as fall within the scope of the appended claims.

What is claimed is:

1. An electrical heating element for heating liquid flowing therethrough, comprising: an electrically insulated housing having an inlet, an an outlet, and liquid conducting duct means between said inlet and said outlet for the liquid to be heated; electrical heating coils within said duct means; said housing having an inner part and an outer sleeve part detachably and telescopically receiving with a snug sliding fit said inner part; said inner part having a continuous channel with return bend and adjacent channel portions, with partition walls between adjacent channel portions, and with said channel being open on one side over its entire length; when telescopically assembled, said outer sleeve part closing the open side of said channel to thereby form between said outer sleeve part and said inner part said duct means; sealing means between said inner part and said outer sleeve part for sealing the interior of said housing containing therein said duct means except for said inlet and said outlet; said outer sleeve part and said partition walls having form interlocking sealing means telescopically assembled with a close sliding fit between adjacent channel portions.

2. A heating element according to claim 1, wherein said form interlocking sealing means are tongue and groove joints.

3. A heating element according to claim 2, wherein said tongue and groove joints are provided between the inner surface of said outer sleeve part and the facing partition walls of said inner part at said one side, and said joints extend for the length of said partition walls between adjacent channel portions.

4. A heating element according to claim 2, wherein said form interlocking sealing means includes a tongue and groove and telescopic sliding joint between the side of said inner part opposite from said one side and the adjacent surface of said outer sleeve part, and extend the entire length of said opposite side.

5. A heating element according to claim 3, wherein the grooves of said form interlocking sealing means are within the inner surface of said outer sleeve part that faces said one side of said inner part, and the tongues of said form interlocking sealing means are provided as terminal projections on said partition walls.

6. A heating element according to claim 4, wherein there are two tongues parallel to each other extending outwardly from said opposite side of said inner part, and wherein there are two mating grooves within the adjacent surface of said outer sleeve part.

7. A heating element according to claim 5, wherein said form interlocking sealing means includes a tongue and groove and telescopic sliding joint between the side of said inner part opposite from said one side and the adjacent surface of said outer sleeve part, and extend the entire length of said opposite side; and wherein there are two tongues parallel to each other extending outwardly from said opposite side of said inner part, and wherein there are two mating grooves within the adjacent surface of said outer sleeve part.

8. A heating element according to claim 7, wherein said outer sleeve part has a closed end provided with said inlet and said outlet, and further provided with two electrical connectors extending through said outer sleeve part for electrical connection with said heating coils; said open end of said outer sleeve part telescopically receiving said inner part with said first mentioned sealing means therebetween, and further provided with releasable fastener means for maintaining said inner part and outer sleeve part in the assembled position.

9. A heating element according to claim 8, wherein said inner part is provided with an end wall flange having a plurality of bores extending in the direction of the telescopic assembly for receiving therein said releasable fastener means, a circumferencial sealing surface facing said open end of said outer sleeve part for engagement with said first mentioned sealing means, and an outwardly extending reinforcement rib and handle means.

10. A heating element according to claim 2, including a through bore extending at least through said outer sleeve part transversely to the direction of telescopic assembly and out of fluid communication with said duct means, to provide means for mounting the heating element.

* * * * *